US005214253A

United States Patent [19]

Houston, Jr.

[11] Patent Number: 5,214,253

[45] Date of Patent: May 25, 1993

[54] AUTOMOTIVE EXHAUST SYSTEM

[76] Inventor: Richard G. Houston, Jr., 1849 Service Dr., Marietta, Ga. 30066

[21] Appl. No.: 605,104

[22] Filed: Oct. 26, 1990

[51] Int. Cl.[5] ..... F01N 7/00

[52] U.S. Cl. ..... 181/238; 181/239; 181/240; 181/265

[58] Field of Search ..... 181/212, 264, 265, 266, 181/268, 269, 275, 238, 239, 240

[56] References Cited

U.S. PATENT DOCUMENTS

| | | | |
|---|---|---|---|
| 2,922,486 | 1/1960 | McRee et al. | 181/57 |
| 2,996,139 | 8/1961 | Patterson | 181/247 |
| 3,059,423 | 10/1962 | Berlyn | 60/32 |
| 3,447,630 | 6/1969 | Davidson | 181/247 |
| 4,574,914 | 3/1986 | Flugger | 181/268 |
| 4,693,339 | 9/1987 | Beale et al. | 181/255 |
| 4,800,719 | 1/1989 | Campbell | 181/269 |
| 4,841,728 | 6/1989 | Jean et al. | 60/312 |

*Primary Examiner*—Michael L. Gellner

*Assistant Examiner*—Khanh Dang

*Attorney, Agent, or Firm*—Hopkins & Thomas

[57] ABSTRACT

An improved automotive exhaust system comprises a flared expansion chamber having two inlet ports at its narrow end and three outlet ports at its wide end. The inlet ports extend a predetermined distance into the chamber to form therein a pair of lips that function as dams against migration of reversion pulses back up the exhaust pipes. The total area provided by the outlet ports is greater than that provided by the inlet ports. Exhaust gases fed to the chamber can thereby expand as they traverse the length of the chamber and can pass freely from the chamber through the outlet ports. Reversion pulses, which tend to migrate toward the inlet ports along the interior surface of the chamber, encounter and are reflected by the reversion dams and thus are inhibited from migrating back up the exhaust pipes to the engine. Engine performance and usable power is thereby enhanced.

1 Claim, 1 Drawing Sheet

AUTOMOTIVE EXHAUST SYSTEM

TECHNICAL FIELD

This invention relates to automotive exhaust systems and particularly to methods and devices for reducing back pressure and reversion effects within such systems.

BACKGROUND OF THE INVENTION

In order to reduce the noise of combustion and exhaust in an internal combustion engine, exhaust gases from the engine are typically passed through a muffler or through a set of mufflers. In automotive vehicles, the muffler is usually interposed between the free end of an exhaust pipe, which receives exhaust gases from the exhaust manifold of the engine, and a tail pipe, through which exhaust gases are expelled from the vehicle. While many types of mufflers exist, most of them reduce noise by directing exhaust gases through a series of restricted passageways and resonance chambers to allow for gradual expansion of exhaust gas pulses to form a substantially homogeneous flow of gas that is then expelled through the tail pipe.

While such muffler systems have proven extremely effective in reducing the noise of internal combustion engines, they nevertheless have long beer plagued with some persistent problems inherent in their respective designs. One such problem has been the relatively large back pressure that can be developed by such mufflers because of their inherent resistance to the free flow of gases therethrough. Such back pressure produces a load against which the engine must work and, as a consequence, can significantly reduce the engine's running efficiency and its usable power output.

Another problem that can be greatly enhanced by modern muffler systems has been a phenomenon known as reversion whereby back pressure created by the muffler system in conjunction with the partial vacuum in an exhaust pipe that exists just after expulsion of an exhaust pulse combine to create a reverse high pressure pulse that migrates rapidly up the exhaust pipe toward the engine. These reversion pulses can further reduce the running efficiency of the engine and can even migrate all the way to the carburetor of the engine causing carburetor metering difficulties as well as other related problems. The result is a further reduction in the efficiency of and thus the available power produced by the engine.

While the magnitude of the reduction in engine efficiency and power due to back pressure and reversion is often acceptable in the common family automobile, it can be devastating to the overall performance of a race car where even small variations in engine efficiency and usable power can make the difference between winning and loosing a race. As a consequence, designers of race cars have in the past eliminated mufflers altogether from race car exhaust systems and have simply directed the exhaust gases through an unrestricted exhaust pipe for expulsion from the car. In this way, back pressure and reversion phenomenon were generally reduced to acceptable levels.

More recently, however, legislation and local regulations requiring race cars to be equipped with muffler systems for reducing the noise of their engines have been implemented in many areas of the country. Such requirements have resulted in some instances from the expansion of urban populations that has placed residential neighborhoods in close proximity to previously isolated race tracks. As a consequence of such regulations and requirements, race car engineers and drivers have been forced to install mufflers on race cars and particularly on stock car racers of the type commonly raced on oval dirt tracks.

While the requirement for mufflers on racing vehicles has for the most part been successful in reducing the noise associated with the tracks, it nevertheless has presented new and sometimes overwhelming problems to designers and drivers of race cars. Specifically, the back pressure and reversion phenomenon created or at least greatly enhanced by the required mufflers has tended to reduce significantly the efficiency and available power of race car engines on which such mufflers have been installed. Further, the problems created by back pressure and reversion are enhanced for race cars as opposed to, for example, the family car, since race car engines typically operate at extremely high RPM levels and thus rapid and high pressure exhaust expulsion rates.

Attempts to address these problems have generally included enhanced muffler design. While such enhanced design has in some instances reduced back pressure, the reduction has generally not been adequate. Furthermore, reversion, which can be an even more critical problem than back pressure, has yet to be satisfactorily addressed at all. It is therefore to the provision of an improved exhaust system that functions to reduce significantly the back pressure and reversion effects in the system and thus improve engine performance that the present invention is primarily directed.

SUMMARY OF THE INVENTION

The present invention is an improved exhaust system for internal combustion engines with the system being adapted for use primarily with race car engines to reduce significantly back pressure and reversion effects within the system and thereby increase the efficiency and power of the engine. The system includes a flared expansion chamber having a narrow inlet end and a wide outlet end. Communicating with the chamber at its inlet end is a pair of inlet ducts adapted to couple to the exhaust pipes of the system for delivery of engine exhaust gases to the chamber. The wide end of the chamber includes three outlet ducts for aspiration of gas from the chamber and delivery thereof to the muffler or mufflers of the system, which can be coupled directly to the outlet ducts.

The inlet ducts at the narrow end of the expansion chamber extend into the interior of the chamber a predetermined distance to form a pair of lips or flanges that bound the inlet ports within the chamber. In operation of the system, the lips function as reversion dams that intercept and inhibit reversion pulses, which typically cling to and travel along the interior surfaces of the chamber toward the inlet ports, from entering the inlet ports and thereby migrating through the exhaust pipes to the engine.

In use, exhaust gas pulses from the engine enter the expansion chamber through the inlet ports. The expanding flared shape of the chamber permits the gases to expand as they traverse the length of the chamber thereby reducing their density and consequently their associated pressure. The expanded exhaust gases, then, are aspirated from the chamber through the three outlet ports, which provide virtually unrestricted egress, and are directed to the muffler or mufflers of the system. In the preferred embodiment, each outlet port is coupled to a separate muffler thus providing three mufflers through which exhaust gas passes rather than the one or two typically employed in unimproved systems. As a result, the back pressure within the system is reduced significantly.

Even though back pressure is reduced, reversion pulses can still be created in the expansion chamber by the reduced back pressure and the partial vacuum within the exhaust pipes after expulsion of an exhaust pulse. Since reversion pulses are basically expanding wavefronts, they tend to migrate in an upstream direction along the interior walls of the chamber toward the inlet ports. At the inlet ports the reversion pulses are intercepted by the reversion dams created by the inwardly extending lips that bound the inlet ports. The reversion pulses are then simply reflected by the dams such that they move back toward the outlet end of the expansion chamber where they can be harmlessly expelled. Reversion pulses are thus inhibited from entering the inlet ports and migrating back to the engine through the exhaust pipes.

Thus, an improved exhaust system is now provided that significantly reduces back pressure by expanding exhaust gases and delivering the expanded gasses to an array of mufflers. In addition, reversion pulses created within the system are effectively inhibited against migration back up the exhaust pipes toward the engine by interposition of a pair of reversion dams within the expansion chamber surrounding and bounding the inlet ports. As a consequence, back pressure and reversion are reduced simultaneously by the present invention thereby increasing the efficiency and usable power of the engine. These and many other features, objects, and advantages of the invention will become more apparent upon review of the following detailed description taken in conjunction with the accompanying drawings.

DETAILED DESCRIPTION OF THE PREFERRED EMBODIMENT

Figure 1:
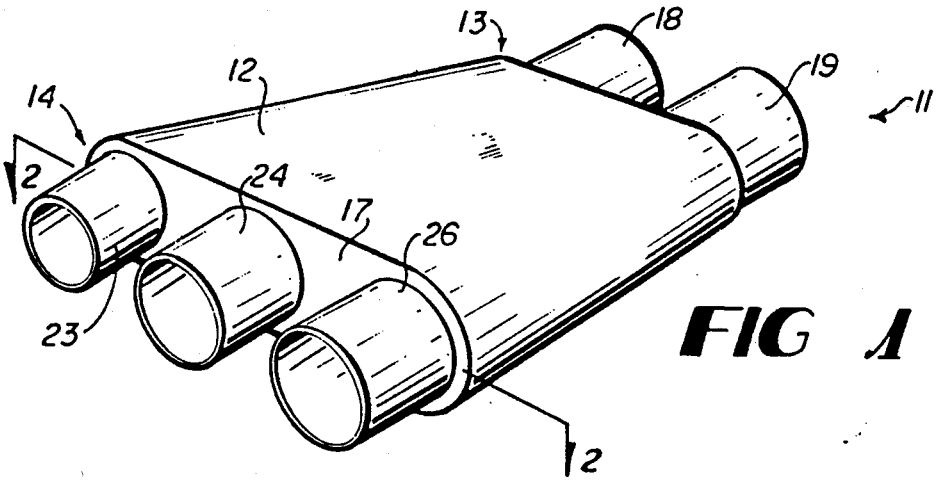
FIG. 1 is a perspective view of an apparatus that embodies principals of the present invention in a preferred form illustrating the flared expansion chamber, the inlet ports, and the outlet ports.

Referring now in more detail to the drawings, in which like numerals refer to like parts throughout the several views, FIG. 1 illustrates an apparatus that embodies principles of the present invention in a preferred form. The apparatus 11 is seen to comprises a flared substantially trapezoidal shaped expansion chamber 12 having a narrow end 13 and a wide end 14. While the chamber 12 can be constructed of any suitable heat resistant material, it has been found that a construction of rolled welded steel is durable and performs well in environments often encountered in racing.

The narrow end 13 of the chamber 12 is closed with an end plate 16 (FIG. 2) and, similarly, the wide end 14 is closed with an end plate 17. Protruding through the end plate 16 to communicate with the interior of the chamber 12 is a first substantially cylindrical inlet port 18 and a second substantially cylindrical inlet port 19. The inlet ports 18 and 19 are securely welded to the end plate 16 and extend into the interior of the chamber 12 a predetermined distance as shown to define lips 21 and 22 respectively within the chamber.

Securely welded to the end plate 17 and communicating with the interior of the chamber 12 at its wide end are three tubular outlet ports 23, 24, and 26. These outlet ports are preferably equally spaced along the end plate 17 and each outlet port has a diameter that is substantially the same as the diameters of the inlet ports 18 and 19. In this way, the ratio of the total outlet area provided by the outlet ports to the total inlet area provided by the inlet ports is approximately three to two.

While the size and shape of the flared expansion chamber 12 may vary according to a specific purpose, it has been found that a trapezoidal shaped chamber being approximately 9" wide at its narrow end, 13.5" wide at its wide end, 4.5" thick, and 18" long performs exceptionally well in exhaust systems of stock car engines of the type usually used in oval track and other types of racing. Further, it has been found that an inlet and outlet port diameter of approximately 3.5" is preferable since such diameter corresponds to standard sizes of exhaust pipes, tail pipes, and muffler fittings. Finally, while the inlet ports 18 and 19 may be configured to extend into the chamber 12 to form lips 21 and 22 of various sizes, lips that extend approximately 2" into the interior of the chamber have been found to form efficient reversion dams that prevent reversion pulses from migrating back up the exhaust pipes to the engine.

OPERATION

Figure 3:
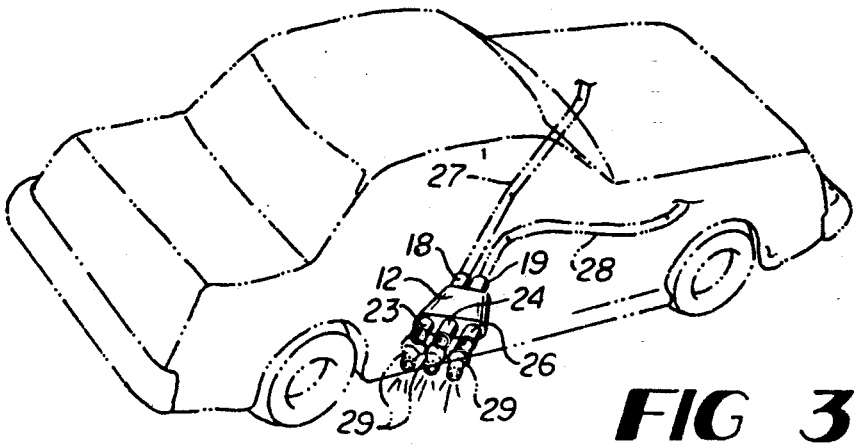
FIG. 3 is a perspective view of the system of the present invention as preferably installed in a race car.

FIG. 3 illustrates the common placement and operation of the system of the present invention in a vehicle such as a race car. Left and right exhaust pipes 27 and 28 respectively communicate with and extend from the left and right exhaust manifolds of the car's engine (now shown). The left exhaust pipe 27 is coupled at its end to the first inlet port 18 through which it communicates with the interior of the expansion chamber 12. Similarly, the right exhaust pipe 28 communicates with inlet port 19 and thereby communicates with the interior of the expansion chamber 12. In practice, the ends of the exhaust pipes 23 and 24 may be flared to receive the inlet ports 18 and 19 whereupon the exhaust pipe ends and inlet ports can be securely clamped together. Alternatively, the ends of the exhaust pipes can be welded or otherwise permanently secured to the inlet ports 18 and 19 if desired.

While the system of this invention can be used with or without mufflers, it is typically used in racing environments with mufflers such as, for example, Low Back brand mufflers that can be coupled to the outlet ports 23, 24 and 26. Specifically, and with reference to FIG. 3, the racing mufflers 29 can be coupled to each of the outlet ports 23, 24 and 26 with the muffles extending from beneath the car to expel exhaust gases therefrom. As with the exhaust pipes, the mufflers can be welded, clamped or otherwise secured to the ends of the outlet ports as desired.

In operation, exhaust gases from the running engine are directed by the exhaust pipes 27 and 28 through the inlet ports 18 and 19 and into the expansion chamber 12. The exhaust gases enter the expansion chamber in the form of sequential high pressure pulses that result from rapid expulsion of the gases from the engine's cylinders by the moving pistons during the exhaust strokes thereof.

As each pulse enters and moves along the length of the expansion chamber 12, the gases within the pulse are free to expand by virtue of the expanding trapezoidal shape of the chamber. This expansion reduces the pressures within each pulse and thereby reduces the severity of the pulse by the time it reaches the wide end 14 of the expansion chamber 12. The expanded less severe pulse, then, is free to exit the chamber through the three outlet ports 23, 24, and 26, which provide non-restricted and free egress of the gases from the chamber by virtue of the three to two outlet to inlet area ratio provided by the ports. The exhaust gases, then, move into and through three mufflers 29 rather than one or two that are typically used with unimproved systems thereby apportioning the flow of gases between the three mufflers and reducing significantly the back pressure caused by the muffler system.

Just after a pulse enters the expansion chamber 12 through one of the inlet ports 18 or 19, there exists in the corresponding exhaust pipe a partial vacuum resulting from the rapid expulsion of the pulse. This partial vacuum in combination with even the reduced back pressure that is present in the system tends to cause a rapid reverse pressure pulse or wave front that moves from the outlet end of the expansion chamber toward the inlet ports thereof. As discussed hereinabove, this phenomenon is known as reversion and can greatly decrease the efficiency and power of the engine in many instances.

Figure 2:
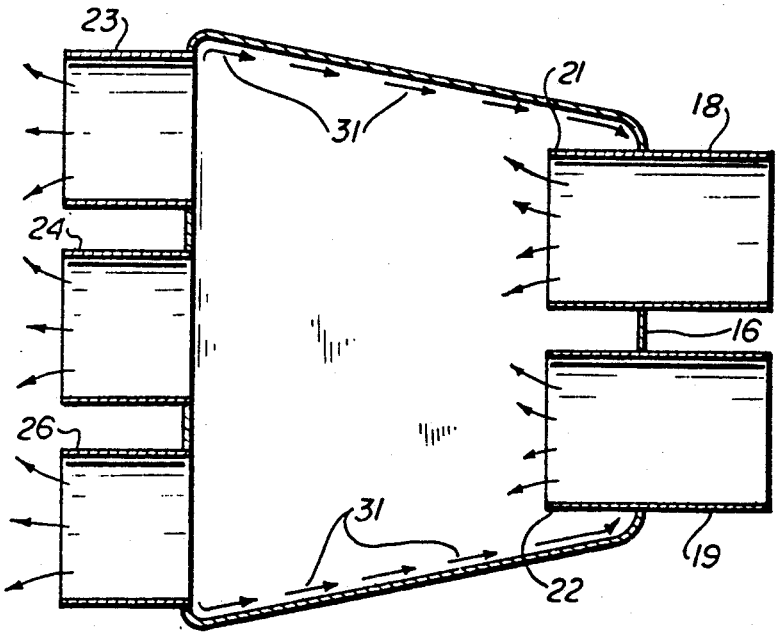
FIG. 2 is a sectional view taken along line 2—2 of FIG. 1 showing the internal shape of the expansion chamber and the reversion dams created by the inwardly extending lips of the inlet ports.

As illustrated in FIG. 2, reversion pulses 31 of the type discussed tend, because of their fundamentally expanding nature, to cling to and rush along the inside walls of the expansion chamber 12 toward the inlet ports 18 and 19. As a given reversion pulse rushes toward the inlet ports, the pulse is forced to compress because of the narrowing configuration of the expansion chamber in the direction of movement of the pulse. This compression tends to increase the speed of the pulse as it approaches the inlet ports 18 and 19.

Once the reversion pulse reaches the position of an inlet port, it encounters the lips 21 and 22 that form the reversion dams within the chamber. At this juncture, the reversion pulse tends to reflect from the reversion dams rather than migrating up the walls of the dam because of the discontinuous intersection of the lips with the chamber walls. The reflected reversion pulse, then, migrates and expands back along the length of the expansion chamber 12 where it is diluted and reduced in severity and tends to exit through the outlet ports 23, 24, and 26. The reversion pulse 31 is therefore inhibited by the reversion dams from entering the inlet ports and thereby migrating back up the exhaust pipes 27 and 28 toward the engine. Engine efficiency and usable power output is therefore increased since interference form reversion is greatly reduced.

Thus it is seen that the improved exhaust system of the present invention effectively addresses both the problem of back pressure created by mufflers in the system and the problem of reversion pulses that result from the combination of back pressure and partial vacuum within the system. In practice, it has been found that use of the present system in a stock car racing environment can increase the usable horse power output of an engine by as much as 10%. Such increase has been found in many cases to convert an otherwise average stock car racer into a highly competitive vehicle that can noticeably outperform vehicles equipped with prior art unimproved exhaust systems.

The invention has been described herein in terms of a preferred embodiment. It will be obvious to those of skill in the art, however, that many modifications, deletions and additions might be made to the illustrated embodiment within the scope of the invention. The ratio of inlet to outlet port area, for example, might be different than that of the illustrated embodiment. Further, reversion dams of various sizes and configurations might be used depending upon the particular needs of the vehicle. Furthermore, while the invention has been illustrated with reference to race car engines, it is also applicable to and can increase the performance of any types of internal combustion engines including those in passenger cars, emergency generators, and the like. These as well as other modifications might well be made to the illustrated embodiment without departing from the spirit and scope of the invention as set forth in the claims.

I claim:

1. For use with an engine having an exhaust system that includes at least one exhaust pipe coupled to receive exhaust gases from the engine and direct them away from the engine, an apparatus for reducing back pressure within the exhaust system and inhibiting reversion pulses from migrating through the exhaust pipe to the engine, said apparatus comprising:

an expansion chamber having an inlet end and an outlet end;

at least one inlet port communicating with said expansion chamber at its inlet end with said inlet port being adapted to be coupled to receive exhaust gases from said exhaust pipe;

at least one outlet port communicating with said expansion chamber at its outlet end;

said inlet port defining an inlet area and said outlet port defining an outlet area and wherein the ratio of said outlet area to said inlet area is greater than one;

means within said expansion chamber for intercepting reversion pulses moving toward said inlet port and inhibiting the pulses from entering the inlet port and thereby migrating back through the exhaust pipe to the engine;

said expansion chamber being configured to flair outwardly from its inlet end to its outlet end; and said expansion chamber being generally trapezoidal in shape with the inlet end of said expansion chamber being the narrow end thereof and with the outlet end of said expansion chamber being the wide end thereof.

* * * * *